United States Patent [19]

Gross

[11] 4,173,915

[45] Nov. 13, 1979

[54] PROGRAMMABLE DYNAMIC FILTER

[75] Inventor: Glenn M. Gross, Chicago, Ill.

[73] Assignee: Norlin Industries, Inc., Lincolnwood, Ill.

[21] Appl. No.: 920,277

[22] Filed: Jun. 29, 1978

[51] Int. Cl.[2] ..... G10H 1/02; G10H 5/00

[52] U.S. Cl. ..... 84/1.19; 84/1.26; 84/DIG. 9; 84/DIG. 10; 328/167; 333/172 CR; 364/724

[58] Field of Search ..... 84/1.11–1.13, 84/1.19, 1.21, 1.24, 1.26, DIG. 9, DIG. 10; 307/295; 328/167; 332/17, 18; 333/17 R, 70 R, 70 CR; 364/724

[56] References Cited

U.S. PATENT DOCUMENTS

| | | | |
|---|---|---|---|
| 3,913,442 | 10/1975 | Deutsch | 84/1.19 |
| 3,974,461 | 8/1976 | Luce | 332/17 |

*Primary Examiner*—Stanley J. Witkowski

*Attorney, Agent, or Firm*—Ronald J. Kransdorf; Jack Kail

[57] ABSTRACT

A programmable dynamic filter for use with a time-shared electronic organ or the like includes a filter circuit responsive to a logical state of a control signal for tracking notes generated by the instrument. Means are provided for programming the filter independently of generated notes by selectively adjusting the pulse width of the control signal to achieve desired musical effects.

9 Claims, 6 Drawing Figures

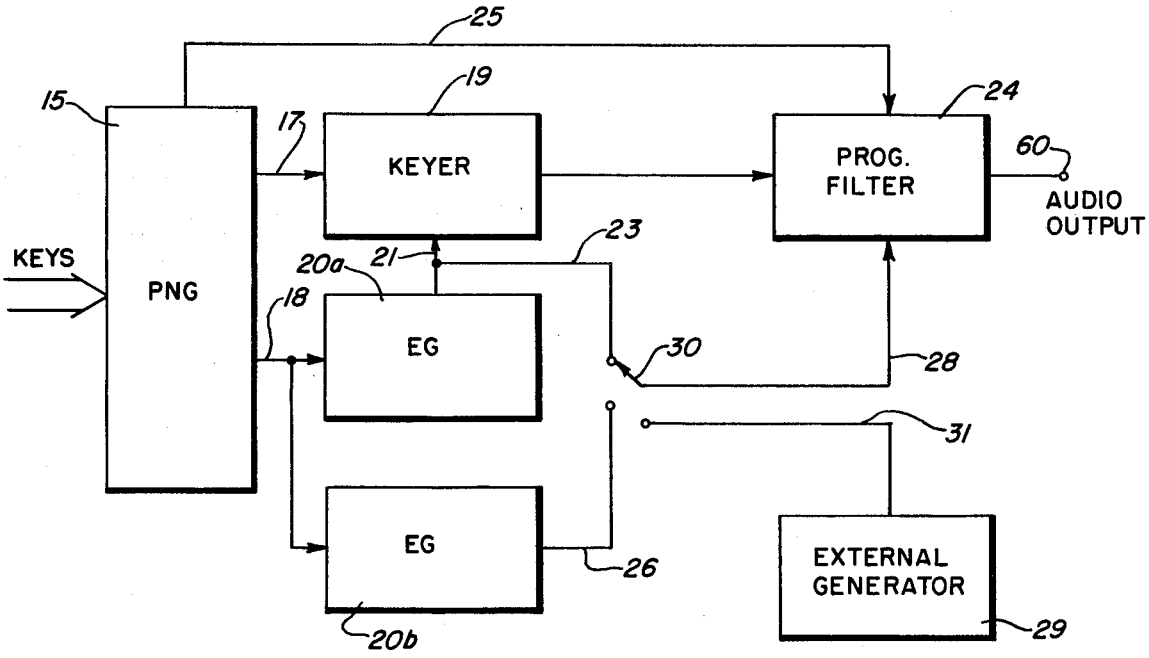
FIG. 1
FIG. 4
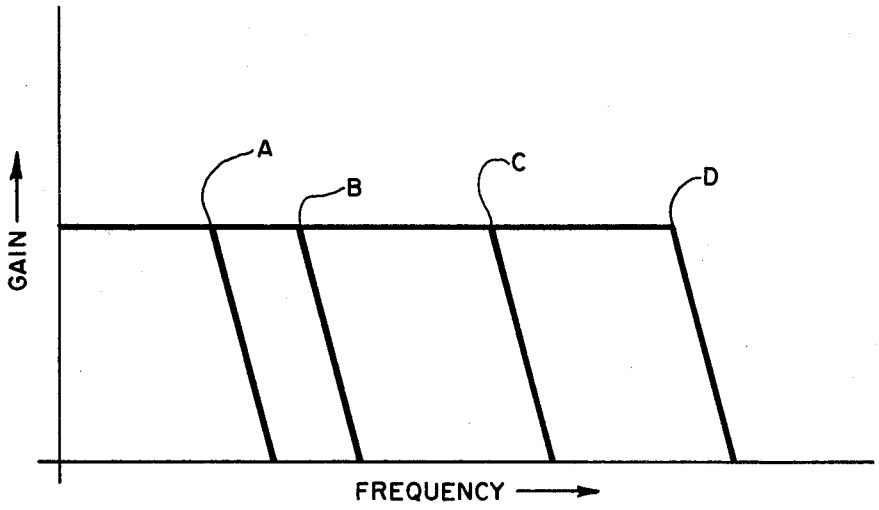

PROGRAMMABLE DYNAMIC FILTER

BACKGROUND OF THE INVENTION

The present invention relates to programmable circuits for electronic musical instruments. More particularly, the invention relates to programmable dynamic filters for use with time-shared electronic organs having frequency response characteristics which are controllable independently of the audio frequency of the musical note being played.

Conventionally, electronic musical instruments such as organs and synthesizers employ tone generators of two general types. Synthesizers have generally utilized a voltage-controlled oscillator, the control voltage applied thereto being a function of the note to be sounded. These systems are monophonic, being adapted to sound only a single note at a time. Organs have normally utilized either a separate oscillator for each note which is to be generated or a single oscillator whose output is passed through suitable dividers to obtain signals at each frequency which the instrument will be required to sound. Separate keyer circuits, envelope generators and filters are employed to suitably shape the tone signals, and many such circuits are required to produce a variety of different tones and voices. These circuits are each dedicated to respective audio tone signals of particular frequencies in order that their timing characteristics may be "tuned" to those frequencies. As a result, hundreds of circuits are required in a prior art organ. This multiplicity of circuitry significantly affects the size, weight, complexity, power consumption and cost of the instrument.

Recently, time-shared systems have been proposed which greatly reduce the number of circuits which are required to implement an electronic organ. One such system is disclosed in co-pending application Ser. No. 835,832, filed Sept. 22, 1977 in the name of Richard S. Swain et al, entitled "Tone Generating System for Electronic Musical Instrument" and assigned to the assignee of the present invention. A variety of programmable circuits for use with the Swain et al system are disclosed in co-pending application Ser. No. 835,695, filed Sept. 22, 1977 in the name of Glenn Gross, entitled "Programmable Circuits for Electronic Musical Instrument" and also assigned to the assignee of the present invention.

In the time-shared electronic organ disclosed in the foregoing co-pending applications, a limited number, preferably ten or twelve, of musical note-sounding channels are provided. Each channel, which typically consists of a priority note generator, an envelope generator and driver, a programmable keyer and a programmable filter, can be assigned as needed to sound any note in the entire musical range of the instrument by the use of time-shared techniques. Moreover, to further reduce circuit multiplicity, the frequency dependent circuits of each channel, such as the filters, are programmable to facilitate the use of a single filter for processing all the musical tones which may be produced by a particular note generator. In other words, the frequency response of a channel filter is preferably tailored according to the frequency of the note being generated in order to maintain proper musical characteristics. Thus, for example, the filter would exhibit a relatively high frequency range for the higher pitch musical notes produced by the tone generator and a lower frequency range for the lower pitch notes. This is accomplished by generating an encoded signal identifying the octave or half-octave in which a generated tone signal is contained and programming the filter in accordance therewith. The filter is thereby operated to exhibit an appropriately different response depending upon the frequency of the generated tone signal, this technique being commonly referred to as "tracking." Each different frequency response is characterized by a respective frequency range normally referred to as the tracking interval of the filter.

However, in order to achieve certain musical effects, it may be desirable to program the channel filter for modulating the filter's frequency response or tracking interval beyond or in addition to the response achieved from slavishly tracking or following the tone being played. Stated otherwise, the channel filter should be programmable for initially tracking the tone being played and should further be independently controllable whereby this initially tracking interval may be adjusted or modulated to produce various desired effects.

Various techniques for modulating a filter beyond its initial tracking interval corresponding to a tone being sounded are known in the art. In one such system, an exponential converter operates a voltage-controlled filter, the filter having an input for receiving a generated tone signal. The exponential converter has two inputs, one input being connected for receiving a DC signal corresponding to the selected note and the other receiving an independently derived modulating signal. The output of the converter is therefore an analog signal operating the voltage-controlled filter in response to both the note being played and the independently derived modulating signal. Systems of this type, being analog in nature, are not readily suited for inclusion in a time-shared digital electronic organ of the variety disclosed in the previously mentioned co-pending applications.

U.S. Pat. No. 3,974,461 to Luce discloses another prior art filter which may be operated for modulating its tracking interval beyond an initial tracking interval corresponding to a note being played. In the Luce system, a filter is provided consisting of a series of gates interposed between a plurality of individual low-pass filter sections. The frequency response or tracking interval of the aggregate filter is therefore determined by the conduction states of the gates. Control of the gates is affected by the output of a monostable multivibrator which develops output pulses of fixed duration at a repetition rate determined by a voltage-controlled oscillator connected to its input. The voltage-controlled oscillator is, in turn, operated in response to an analog input signal derived from a summing circuit which may combine a keyboard related analog signal as well as an independently generated modulating signal. It will be appreciated that the repeition rate of the pulses produced by the monostable multivibrator, which is ultimately dependent upon the analog signal developed by the summing circuit, controls the frequency response and therefore the tracking interval of the filter. This signal, which is partly digital in nature and partly analog, is also not readily suited for incorporation in a completely digital time-shared instrument. Furthermore, quite contrary to the teachings of this reference, the elimination of voltage-controlled ocillators is one of the primary purposes of time-shared systems.

SUMMARY OF THE INVENTION

It is a primary object of the invention to provide a new and improved programmable filter for use with a time-shared electronic organ or the like.

It is more specific object of the invention to provide a programmable filter for use with a time-shared electronic organ whose initial tracking interval, corresponding to the frequency of a note being sounded, is independently adjustable to achieve desired musical effects.

In accordance with these and other useful objects, an improved programmable filter is provided for use with a time-shared electronic organ or the like. The organ includes means for generating a digital encoded control signal defining the portion of the musical scale containing a generated tone signal. The programmable filter includes a plurality of analog switches connected in association with a filter circuit such that the filter is responsive to a logical state of the encoded control signal for tracking notes sounded by the organ. The filter further includes a circuit coupled between the instrument and the analog switches which is responsive to a modulating signal for selectively varying the pulse width of the pulses comprising the control signal. By suitably varying the pulse width of the control signal the intial tracking interval of the filter, which is dependent upon the frequency and pulse width of the unmodified control signal, may be modulated or adjusted independently of the tone signal being sounded.

The pulse width modification circuit may comprise a voltage-controlled monostable multivibrator responsive to the control signal and an independently developed modulating signal. In this embodiment, control signal pulses trigger the monostable multivibrator while the voltage of the modulating signal determines its unstable state duration. Alternatively, a bi-stable device such as a flip-flop circuit may be used as a pulse width modification device. In this case, the control signal pulses repetitively set the bi-stable device while a logic circuit repetitively resets the device under the control of a selectable digital code representing the modulating signal.

In either embodiment, the pulse width of the control signal pulses may be effectively controlled for modulating the programmable filter beyond its initial tracking interval corresponding to the note presently being sounded.

BRIEF DESCRIPTION OF THE DRAWINGS

FIG. 1 is a block diagram showing a portion of an electronic musical instrument embodying the programmable filter of the present invention.

FIG. 4 illustrates various exemplary frequency response characteristics of the filter of the invention, the characteristics being related to the waveforms of FIG. 3.

DESCRIPTION OF THE PREFERRED EMBODIMENTS

Figure 2:
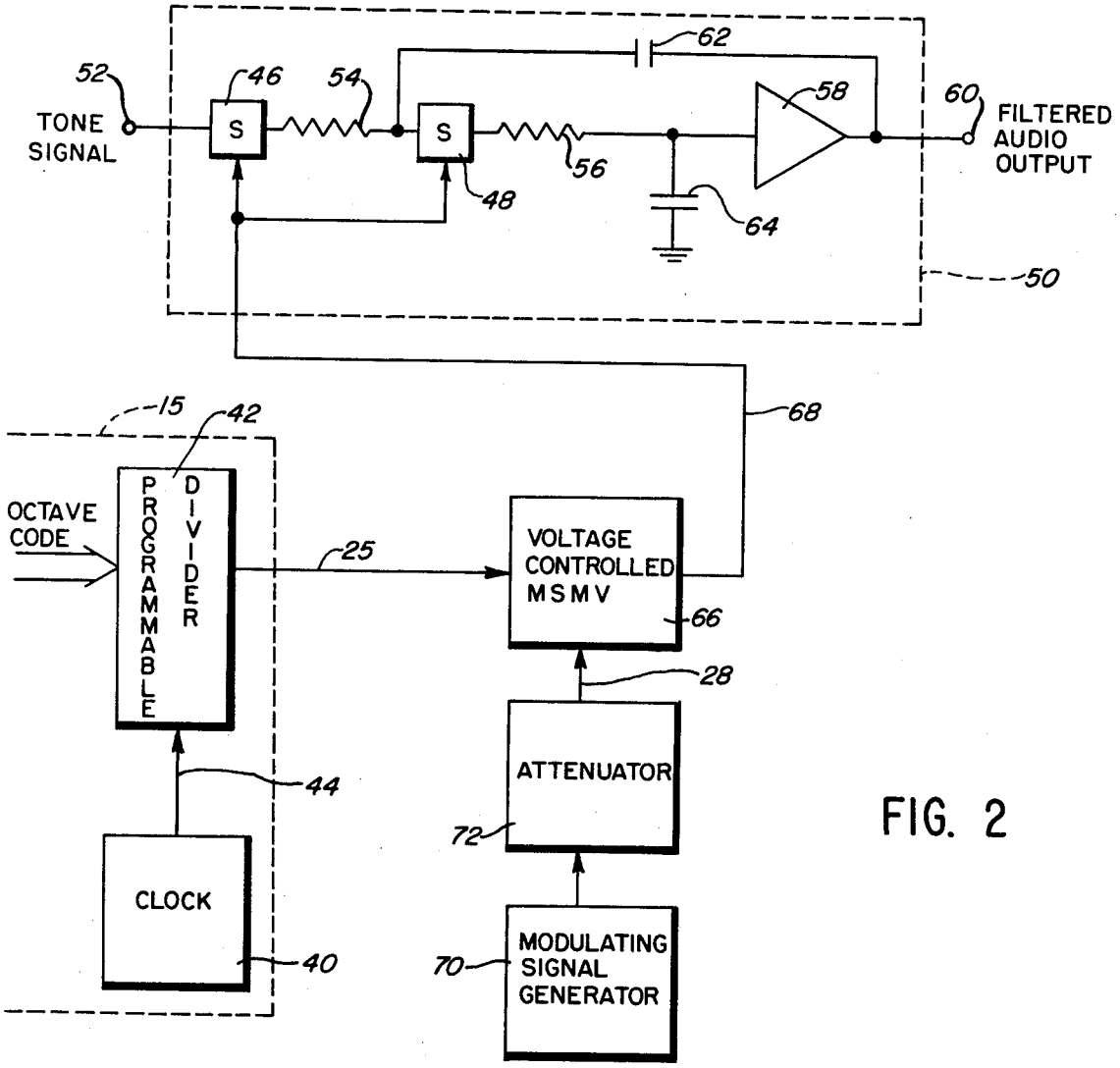
FIG. 2 is a block diagram, partly in schematic form, showing a preferred embodiment of the programmable filter of the invention.

Referring now to the drawings, FIG. 1 shows in general terms a fragment of an electronic musical instrument incorporating the present invention. The omitted portions of the musical instrument are either conventional in nature or are disclosed in detail in the above-cited co-pending applications. The musical instrument is preferably of the type which has a keyboard, such as a synthesizer or organ. Each of the keys on the keyboard, when operated by the musician, closes a switch resulting in the circuit of FIG. 1 generating and processing an electronic tone signal, the fundamental frequency of which is equal to the pitch of the selected musical note.

The circuit which generates the electronic tone signal is a priority note generator 15, a specialized digital circuit which is preferably realized in the form of an integrated circuit. In brief terms, the priority note generator is a circuit in which a high frequency clock pulse train is divided down to any desired musical frequency by means of a digitally controlled programmable divider to produce a musical tone signal. Further details of the priority generator and its operation are disclosed in the co-pending applications cited above. The priority note generator has a number of output lines. The tone signal is developed on a line 17 and coupled from priority note generator 15 to a keyer 19. A drive signal is developed on a line 18 and coupled to a pair of envelope generators **20*a* and 20*b*. Envelope generator 20*a*, which is coupled to keyer 19 by a line 21, produces an envelope signal simulating the attack and decay characteristics of an acoustical tone. The envelope signal produced by generator 20*a* is combined with the tone signal on line 17 by keyer 19 and applied to a programmable filter circuit 24. Programmable filter 24 is controlled by a serial bit code developed on a line 25 by priority note generator 15, the code being dependent upon the frequency of the tone signal being generated. In this manner, the frequency response characterizing filter 24 is continuously adjusted according to the code developed on line 25 and therefore according to the note selected for production by priority note generator 15. Thus, for example, when a high frequency note is selected, priority note generator 15 develops a code on line 25 causing programmable filter 24 to exhibit a relatively high cut-off frequency. On the other hand, for lower frequency notes, the code developed on line 25** results in the formulation of correspondingly lower cut-off frequencies.

As so far described, the circuit of FIG. 1 is entirely disclosed in the two co-pending applications cited above. The present invention focuses on ways in which the flexibility of programmable filter 24 is increased for providing musical effects not strictly dictated by the control code developed on line 25. As will be explained in further detail hereinafter, the foregoing is, in part, accomplished by means of, for example, the connection of envelope generators **20*a* and 20*b* and/or an external generator 29 via lines 23, 26, 28 and 31 and switch 30 to programmable filter 24**.

One embodiment of the invention is illustrated in detail in FIG. 2. In accordance with the previously discussed co-pending applications, priority note generator 15 develops on output line 25 a serial code defining the octave or half-octave of the musical scale containing the note being simultaneously generated. Either the frequency or duty cycle of the control signal developed on line 25 can be suitably adjusted for performing this identification task. In the embodiment illustrated in FIG. 2, priority note generator 15 includes a high frequency clock 40 supplying a clock signal to the clock input of a programmable divider 42 over a line 44. Programmable divider 42, in response to an octave control code, is operable for developing a variable frequency control signal on line 25. Thus, the octave control code programs divider 42 for exhibiting a division factor dependent upon the octave or half-octave of the musical scale containing the tone being sounded. As a result, the frequency of the control signal on line 25 is directly related to the octave or half-octave of the musical scale containing the selected note. It will be appreciated that decreasing the division factor characterizing divider 42 results in a higher frequency control signal on line 25 while increasing the division factor proportionately decreases the frequency of the control signal.

In the previously mentioned co-pending applications, the control signal developed on line 25 is directly applied to a pair of analog switches 46 and 48 forming part of a filter 50. Filter 50 further includes a musical tone signal receiving input terminal 52 coupled to the output terminal of keyer 19 (FIG. 1). The tone signal is coupled through analog switch 46 to one end of a resistor 54 and then through the second analog switch 48 to a second resistor 56. The other end of resistor 56 is connected to an amplifier 58 which drives an output terminal 60. A feedback capacitor 62 is connected from the output terminal 60 to the junction of resistor 54 and switch 48 and a capacitor 64 is connected in shunt with the input terminal of amplifier 58.

Resistors 54 and 56 determine the charging rate of capacitors 62 and 64. When analog switches 46 and 48 are continuously conductive, the filter has one characteristic. When switches 46 and 48 are operated in response to various lower frequency control signals, however, the filter has various different characteristics, because of the change in the average current through resistors 54 and 56. In this manner, i.e. by controlling the characteristics of the filter according to a frequency encoded control signal which is dependent upon the octave or half-octave of the musical scale containing a selected note, the filter is made to track the tones being sounded by the instrument.

According to the present invention, a pulse width adjusting device is interposed between programmable divider 42 and analog switches 46 and 48 for the purpose of controlling the characteristics of filter 50 independently of the tone signals being sounded. Thus, for example, in FIG. 2 a voltage-controlled monostable multivibrator 66 has an input connected for receiving the control signal developed on line 25 and an output connected to analog switches 46 and 48 by a line 68. A modulating signal is developed by a modulating signal generator 70 and coupled through an attenuator 72 to the control input of monostable multivibrator 66.

Monostable multivibrator 66, which may be a 555 type timing circuit available from a number of manufacturers, is triggered into its unstable state by the pulses comprising the control signal on line 25 for a time duration dependent upon the voltage developed at the output of attenuator 72. Therefore, the width of the pulses comprising the control signal may be selectively varied by generating suitable modulating signals and attentuating them by a desired amount.

In this regard, it will be appreciated that modulating signal generator 70 may comprise either external generator 29 or, alternatively, envelope generators 20*a* or 20*b*. Thus, the modulating signal supplied to monostable multivibrator 66 may take any of a number of forms and may comprise, for example, a DC signal or an AC signal developed by external generator 29 which may be manually operable by means of a suitable potentiometer or the like or which may comprise various other forms of signal generation apparatus for providing any desired modulating signal. The modulating signal may also be derived from envelope generator 20*a* or envelope generator 20*b* by operation of switch 30 whereby it would simulate the attack and decay characteristics of the respective generators.

Figure 3:
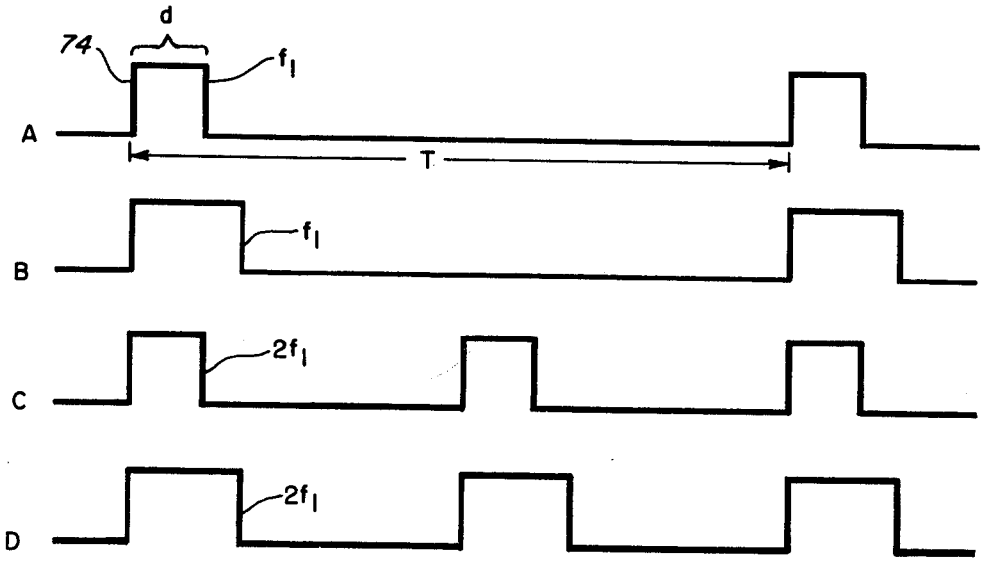
FIG. 3 illustrates various exemplary waveforms useful in explaining the operation of the circuit shown in FIG. 2.

Operation of the circuit illustrated in FIG. 2 can be conveniently explained with reference to the waveforms shown in FIGS. 3 and 4. Waveform A of FIG. 3 represents a control signal developed on line 25 having a frequency $f_1$. The frequency $f_1$ directly associates the selected note with the octave or half-octave of the musical scale containing the note. Should a selected note be contained within another octave or half-octave, the frequency of waveform A would change accordingly. For example, waveform C represents a control signal on line 25 having a frequency $2f_1$ and would correspond to a selected note contained within a higher octave or half-octave of the musical scale.

Now, as previously discussed, the frequency response of filter circuit 50 is governed by the conduction times of switches 46 and 48. During a period T of the signal represented by waveform A, the conduction time of switches 46 and 48 corresponds to the width d of pulse 74. Referring to FIG. 4, this would correspond to a filter frequency response or range having a cut-off frequency at A. The frequency range defined by point A may alternatively be referred to as the initial tracking interval of the filter. If a higher frequency note is selected a higher frequency control signal is developed on line 25, such as the signal having a frequency $2f_1$ as represented by waveform C. Since the signal represented by waveform C causes switches 46 and 48 to conduct twice as long as the signal represented by waveform A, the frequency response or initial tracking interval of the filter is increased and characterized by a cut-off frequency at point C. In this manner, the frequency response of filter 50 continuously tracks the control signal developed on line 25 and thereby the frequency of the notes generated by priority note generator 15.

The presented invention allows for increased flexibility in the generation of musical sounds by enabling the tracking interval of filter 50 to be adjusted independently of the frequency of generated tone signals. For example, waveform B represents an output of monostable multivibrator 66 in response to the control signal represented by waveform A and a DC modulating signal supplied from attenuator 72. It will be observed that the pulse width of the signal represented by waveform B is substantially increased relative to the control signal's original pulse width resulting in longer conduction times of switches 46 and 48. Consequently, the initial tracking interval of the filter is increased from point A to point B. The increased bandwidth filter response will, of course, pass a larger number of harmonics of the tone signal creating a different musical effect than would be achieved solely in response to the control signal developed on line 25. The extent of the modulation of the initial tracking interval of the filter is directly related to the increased pulse width of the signal represented by waveform B. This pulse width may be increased by reducing the attenuation introduced by attenuator 72 or by increasing the DC signal developed by modulating signal generator 70. It will in addition be recognized that the pulse width characterizing waveform B can be made smaller than the pulse width characterizing waveform A by suitably setting generator 70 and attenuator 72, in which case the filter response bandwidth or tracking interval is decreased compared to that which would result in response to waveform A. Also, modulating signal generator 70 could supply an alternating signal or any other wave shape to continuously cause the pulse width of the signal represented by waveform B to vary whereby the initial tracking interval defined by point A would similarly vary.

Waveform D of FIG. 3 represents the output of monostable multivibrator 66 in response to a control signal on line 25 corresponding to waveform C and a DC modulating signal identical to that used to generate the signal represented by waveform B. It will be noted that the conduction time of switches 46 and 48 in response to waveform D is twice that in response to waveform B. Therefore, the frequency range of filter 50 in response to the signal represented by waveform D has a cut-off frequency at point D which, in terms of frequency, represents an expanded tracking interval equal to C (corresponding to the initial tracking interval at frequency $2f_1$) multiplied by the ratio B/A. In other words, the expanded tracking interval is a linear function of the initial tracking interval for a constant modulating signal.

In the foregoing embodiment, the invention was shown as controlling the characteristics of a low-pass filter. However, it will be appreciated that filters exhibiting other characteristics, e.g. band-pass and high-pass filters, may likewise be controlled.

Figure 5:
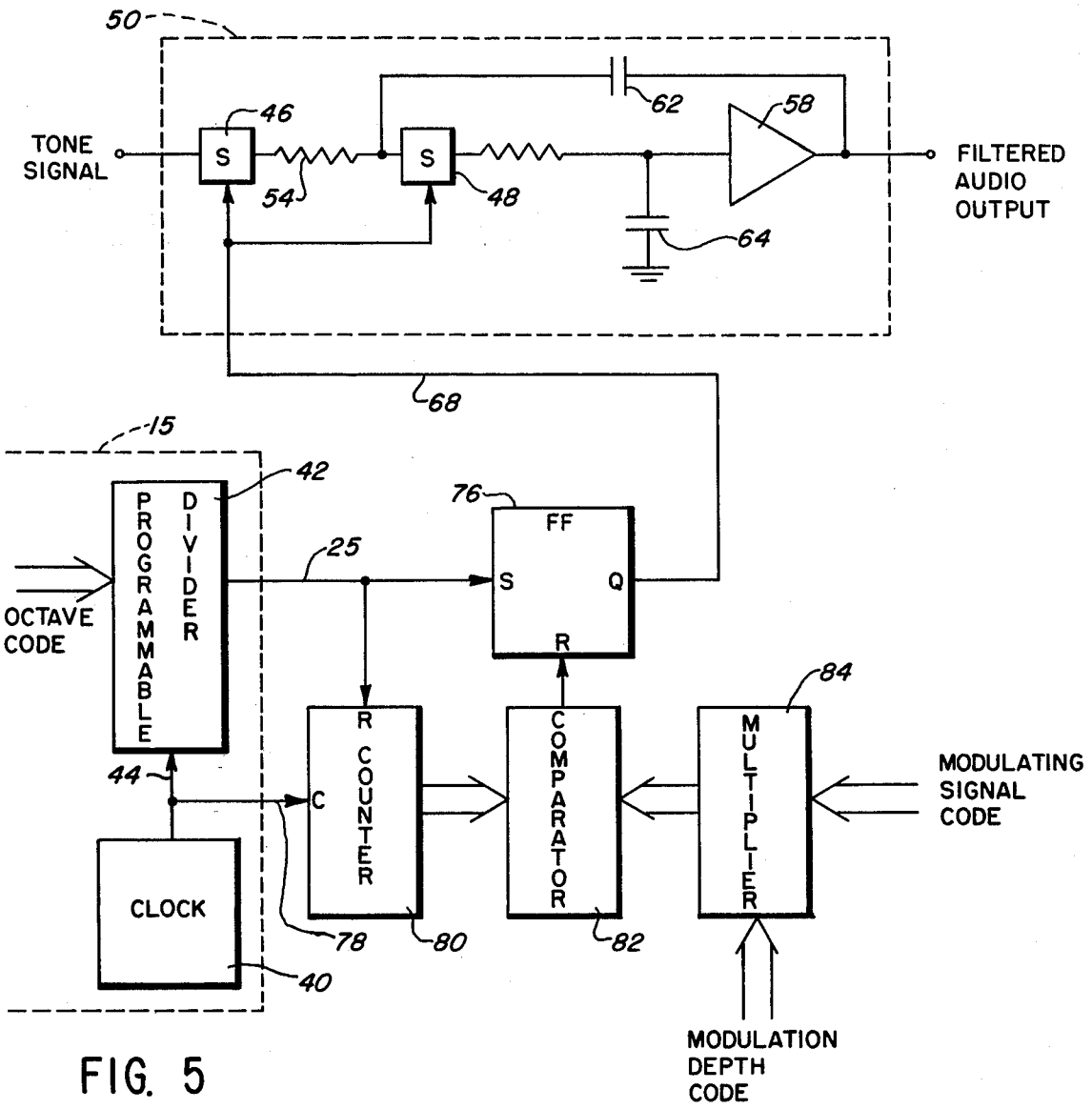
FIG. 5 is a block diagram, partly in schematic form, showing another embodiment of the filter of the present invention.

FIG. 5 illustrates another embodiment of the invention. In this embodiment, a bi-stable device such as a flip-flop 76 is connected between programmable divider 42 and switches 46 and 48, the set input of the flip-flop being supplied by line 25 and its Q output being coupled to switches 46 and 48. The clock pulses developed by clock 40 of priority note generator 15 are coupled by a line 78 to the clock input of a multistage binary counter 80 whose reset terminal is supplied with control signal pulses from line 25. The output of counter 80 supplies one input of a comparator circuit 82, a second input of comparator 82 being supplied with the output of a multiplier circuit 84. The output of comparator 82 is, in turn, connected to the reset terminal of flip-flop 76. Finally, multiplier 84 is supplied with inputs representing a modulating signal code and a modulation depth code. The modulating signal code supplied to multiplier 84 corresponds to the output of modulating signal generator 70 in FIG. 2 while the modulation depth code corresponds to the effect introduced by attenuator 72. The result of multiplying the two codes in multiplier 84 is the production of a code at the second input of comparator 82 representing a modulation function for modulating the tracking interval of filter 50.

In operation, a desired modulation function, represented by a modulating signal code and a modulation depth code, is supplied to comparator 82 from multiplier 84. After being reset by a control signal pulse on line 25, counter 80 proceeds to count clock pulses supplied on line 78. The control signal pulse resetting counter 80 simultaneously sets flip-flop 76 so that the signal on line 68 supplying switch 46 and 48 is logically high. After some period of time, the count developed at the output of counter 80 coincides with the modulation function code and this equality condition is detected by comparator 82 which resets flip-flop 76 causing the output on line 68 to go low. Thusly, a pulse is developed on line 68 in response to a control signal pulse on line 25 and having a duration dependent upon the modulating signal code and modulation depth code supplied to multiplier 84. As in the case of FIG. 2, the width of the pulse developed on line 68 determines the extent to which the initial tracking interval is extended. Moreover, by suitably developing the modulating signal code and modulation depth code various modulation effects such as previously discussed may be achieved.

Figure 6:
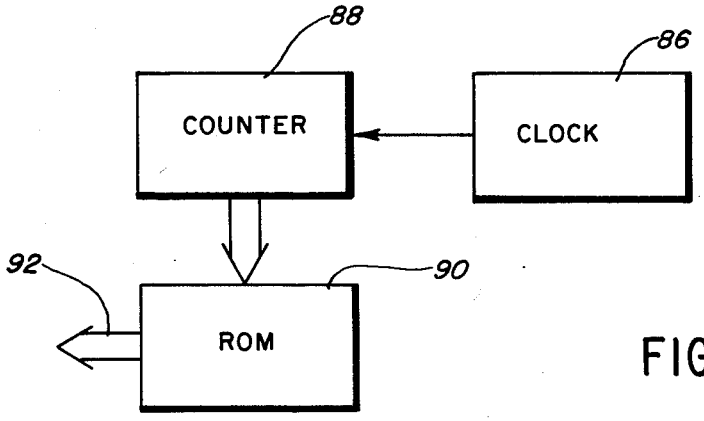
FIG. 6 is a block diagram showing a technique for developing the modulating signal code and modulation depth code used in the circuit of FIG. 5.

A method for developing either the modulating signal code or the modulation depth code is illustrated in FIG. 6. A clock 86, typically operated at a frequency significantly less than the frequency of the clock signal produced by clock 40, supplies a multistage counter 88 which in turn addresses a ROM 90. ROM 90 may be programmed to develop any desired sequence of codes at its output 92 for supplying multiplier 84 in response to addressing signals from counter 88. Alternatively, if a constant code, either a modulating signal code or a modulation depth code, is desired, a suitably preset register may be used to supply the code to multiplier 84. Yet further, a variable signal derived by operation of a potentiometer or the like may be employed to supply an analog-digital converter, which, in turn, would supply multiplier 84 in accordance with the manual or automatic adjustments of the potentiometer.

While particular embodiments of the present invention have been shown and described, it will be obvious to those skilled in the art that various changes and modifications may be made without departing from the invention in its broader aspects. The aim of the appended claims, therefore, is to cover all such changes and modifications as fall within the spirit and scope of the invention.

I claim:

1. In an electronic musical instrument having means for generating tone signals, means for developing a control signal comprising a stream of pulses having a duty cycle determined according to a generated tone signal or a portion of the musical scale containing a generated tone signal and filtering means having a frequency response controlled by the duty cycle of said control signal, the improvement comprising:

first means coupled between said control signal developing means and said filtering means and operable for adjustably varying the pulse width of said pulses for altering the duty cycle of said control signal independently of said tone signal; and second means for controlling said first means for varying the pulse width of said control signal by a selected amount to achieve a desired filtering means frequency response.

2. The improvement according to claim 1 wherein said second means comprises means for generating a modulation signal and means for coupling said modulation signal to said first means.

3. The improvement according to claim 2 wherein said musical instrument includes envelope generating means for developing an envelope signal simulating the attack and decay characteristics of an accoustical tone and means for combining said envelope and tone signals, said envelope generating means comprising said means for generating a modulation signal.

4. The improvement according to claim 2 wherein said first means comprises a voltage-controlled monostable multivibrator responsive to said pulses for assuming its unstable state for a duration determined by the voltage of said modulating signal.

5. The improvement according to claim 4 wherein said means for coupling comprises a variable attenuator.

6. The improvement according to claim 1 wherein said first means comprises a bi-stable device settable to a first logical state in response to said pulses.

7. The improvement according to claim 6 wherein said second means comprises logic means operable for selectively resetting said bi-stable device.

8. The improvement according to claim 7 wherein said logic means comprises:

means for selectively developing a digital code;

means for developing a timing signal in parallel bit format; and comparison means for resetting said bi-stable device in response to the detection of an equality condition between said digital code and said timing signal, whereby the duty cycle of said control signal is adjustable by varying said digital code.

9. The improvement according to claim 8 wherein said timing signal developing means is reset in response to said serial stream of pulses comprising said control signal.

* * * * *